United States Patent [19]

Grützner

[11] Patent Number: 4,559,090

[45] Date of Patent: Dec. 17, 1985

[54] USING A CORROSION PROOF AUSTENITIC IRON CHROMIUM NICKEL NITROGEN ALLOY FOR HIGH LOAD COMPONENTS

[75] Inventor: Günther Grützner, Krefeld, Fed. Rep. of Germany

[73] Assignee: Mannesmann Aktiengesellschaft, Duesseldorf, Fed. Rep. of Germany

[21] Appl. No.: 704,206

[22] Filed: Feb. 22, 1985

[30] Foreign Application Priority Data

Feb. 24, 1984 [DE] Fed. Rep. of Germany ..... 3407307

[51] Int. Cl.[4] ..... C21D 6/02; C21D 7/02; C22C 38/48

[52] U.S. Cl. ..... 148/12 E; 148/11.5 R; 148/11.5 N; 148/12.3; 148/31; 148/38

[58] Field of Search ..... 148/12 E, 12.4, 12.3, 148/11.5 R, 11.5 N, 31, 38

[56] References Cited

U.S. PATENT DOCUMENTS

| | | | |
|---|---|---|---|
| 3,129,120 | 4/1964 | Smith et al. | 148/12 E |
| 3,284,250 | 11/1966 | Yeo et al. | 148/12 E |
| 4,168,190 | 9/1979 | Eguchi et al. | 148/12 E |

FOREIGN PATENT DOCUMENTS

| | | | |
|---|---|---|---|
| 55-8404 | 6/1978 | Japan | 148/12 E |

*Primary Examiner*—Wayland Stallard
*Attorney, Agent, or Firm*—Ralf H. Siegemund

[57] ABSTRACT

A corrosion proof austenitic alloy is proposed for use in components expected to experience also a high mechanical load; the alloy is to have a high yield strength. The alloy is to have a particular composition which is subjected to a heat treatment, subsequent cold working and recrystallization annealing such that nitrogen solid solution hardening, nitride precipitation hardening and strong grain-refinement synergistically combine to obtain high yield strength values beyond those compared to yield point enhancement calculated by only addition of the three hardening effects separately.

8 Claims, No Drawings

USING A CORROSION PROOF AUSTENITIC IRON CHROMIUM NICKEL NITROGEN ALLOY FOR HIGH LOAD COMPONENTS

BACKGROUND OF THE INVENTION

The present invention relates to the utilization of a corrosion proof austenitic iron chromium nickel nitrogen alloy as a structural material for components being subjected to high mechanical loads under corrosive conditions.

Very high pressure pipes and tubings are used for example in chemical engineering, for the conduction of acid gas or for implantates in bone surgery. These parts require steels or alloys which are not only highly corrosion proof but have very high strength because of the high mechanical load it is being subjected to. The 0,2% offset yield strength (0,2-limit) respectively the yield strength (yield point) are the decisive parameter for determining the strength of the material. The construction engineer when designing certain parts requiring corrosion proof material will prefer those with high yield points in order to attain higher load capabilities or because of easier conditions of working. In other cases saving of material or weight or both may lead to thinner or smaller parts, which still have to be strong accordingly.

Austenitic stainless steel or steel alloys usually have favorable corrosion properties and are easier to work than ferritic steels. Since the austenitic structure is primarily stabilized through nickel, such steels are usually alloyed with more than 7% nickel; see for example DIN 17 440, the December 1972 issue and Steel and Iron Material (translated), Flyer 400-73, 4th edition December 1973. Moreover these steels have at least 16% chromium in order to guarantee sufficient passivity. Molybdenum and silicon are added in order to improve the resistance against pitting. Copper is added in order to increase the corrosion resistance by exposure to nonoxidizing acids (see e.g. Hourdremont Handbook of Special Steel Engineering (translated) Springer, Berlin 1956, pages 969,1176, and 1261 et seg.). Increased nickel contents up to about 50% increases the stress corrosion resistance; see for example Berg- und Hüttenmännische Monatshefte 108, page 1/8 and 4 et seg.

Austenitic chromium nickel steels are disadvantaged by their relative socalled 0.2-limits. Through the addition of up to 3% tungsten the strength values can be increased (see for example the particular statement made by Houdremont on pages 899 et seg). Of more importance, however, is the solid solution hardening through the utilization of nitrogen. Thus, the guaranteed minimum values of the 0.2-limits of corrosion proof austenitic steel being only about 200 N/mm$^2$ will be increased by alloying with 0.2% nitrogen resulting in an increase of up to 300 N/mm$^2$ (see for ex. DIN 17440, steel 1.4429 with app. 17.5% chromium, 13% nickel, 3% molybdenum and 0.2% nitrogen). This increase in strength is, generally speaking, approximately proportional with the amount of nitrogen in solution. That increase in strength is however not sufficient for all requirements. Higher contents of up to the limit of solution, in the solid state being about 0.55% nitrogen, are difficult to add owing to the formation of nitrogen bubbles during the solidification build up blowing hole in the casting ingots. Therefore such higher nitrogen contents can be included only if the chromium content is increased to about 24% and if the manganese content is increased to about 5%. Thus, the DEW technical report 13, 1973, page 94–100 describes a steel having 24.5%, 16.8% nickel, 5.5% manganese, 3.2.% molybdenum, 0.16% niobium, 0.46% nitrogen. The guaranteed lowest value of the 0.2 limit with 510 N/mm$^2$ is stated for a solution annealing temperature to be about 1100 degrees C. The values actually measured on hot rolled sheet stock were around 615.670, 725 N/mm$^2$ for solution annealing temperatures amounting respectively to 1100, 1050, and 1000 degrees C.

Steel of the kind referred to in the preceeding paragraph has the disadvantage that it is quite brittle even at temperatures as high as 1000 degrees C. Therefore they precipitate intermetallic phases, and consequently such steel has a relatively low rupture elongation less than about 30%. Moreover such steel is difficult to hot working (see e.g. the citation in the DEW report above, line 11 and also the TEW technical report 2 of 1976, page 159 et seg. as well as METALS ENGINEERING QUARTERLY of Feb. 1971, page 61, 62 and 63.

Another aspect to be considered is that the relatively high chromium and manganese contents are intimately connected with the introduction of nitrogen; this aspect entails a relatively high amount of nickel in order to avoid formation of delta ferrite and of intermetallic phases. All these aspects increase the cost of such material. On the other hand in most cases steel having only about 18% chromium, 12% nickel, and 2% molybdenum are in demand.

Of further significance towards optimizing the yield strength in nitrogen alloyd austenitic steel is the inclusion if niobium as a particular alloying component. It was found for example that aside from the already mentioned nitrogen caused solution hardening effect an additional yield point increase results from niobium owing to the precipitation if niobium containing chromium nitrides of the kind $Nb_2Cr_2N_2$ also called the Z-phase. Thus, the portion of the 0.2-limit attributable to precipitation hardening in such steel which recrystallized through annealing at 1050 degrees C. will amount to only 90 N/mm$^2$ at the most; see for example Thyssen Research, vol. 1 1969, page 10/20 and 14 et seg.

In order to avoid precipitation of less effective niobium nitrides as well as in order to avoid larger losses in nitrogen in the austenitic structure, this kind of all steel has a significantly lower niobium content as compared with the 7-fold amount of nitrogen which is in effect the stoichiometric ratio in the compound NbN.

The third possibility of strengthening i.e. in addition to precipitation and solution hardening, is a grain size reduction or grain-refinement as per ASTM Special Technical Publication, No. 369 of 1965, p. 175–179. After cold rolling and recrystallization annealing of an austenitic steel with approximately 18% chromium and 10% nickel which was not alloyed with nitrogen, a grain size of the number 12.5 in accordance with ASTM (app. 4 micrometers) was obtained. However, the 0.2 limit of only about 300 N/mm$^2$ was attained therewith because both, the nitrogen solution hardening and the nitride precipitation hardening was missing. As compared with a coarser structure of this alloy with a grain size of app. 5.5 (ASTM), being about 50 micrometers and corresponding to the usual solution annealed condition of steels, the yield strength increase amounted to maximum 150 N/mm$^2$ (see e.g. above recited paper, FIGS. 6–9 on page 178).

Scandinavian journal of metallurgy - vol. 6, 1977, pages 156–169 and 162 et seg. suggests a nitrogen alloyed austenitic steel with app. 22% chromium, 10% nickel, 0.27% nitrogen. After cold rolling and a recrystallization annealing it had a smallest grain size of about 10 micrometers (ASTM No. 10) and a 0.2-limit of at the most 490 N/mm$^2$. Strong grain refining did, therefore, not occur. Also a precipitation hardening through chromium nitride could not be ascertained, so that the observed strength enhancement relied exclusively on superimposing nitrogen solution hardening upon grain-refinement (grain size reduction) which however was quite limited owing to still relatively large grains as actually observed.

In view of the corrosion property of the various nitrogen alloyed steels as discussed one should mention that the chromium content diminished to some extent in the austenite result through the formation of $Cr_2N$. This means that the passivity of the steel in the environment of the precipitated particles may be lost. A measure of this type of corrosion is the susceptibility of the steel with regard to grain decay. It was found that steel having app. 18% Cr and 10% Ni will only be prone to corrosion in this regard through annealing above 800 degrees C. whenever the nitrogen content is in excess of 0.27% (see e.g. STEEL AND IRON No. 93, 1973, pages 9–18 and 15 et seg.). As was mentioned earlier, larger amounts of nitrogen can be alloyed into austenitic steel only when the chromium content is increased. Since in accordance with a paper, Berg- und Hüttenmännische Monatshefte (1979), page 508/514–515 and 509 et seg. the tendency for grain decay i.e. for intercrystalline corrosion in a nitrogen alloyed austenitic steel decreases with the chromium content, one cannot expect corrosion problems being attributed to nitrogen to have any significant consequence when used in small proportions in such alloys.

DESCRIPTION OF THE INVENTION

It is an object of the present invention to provide as much as possible an elimination of the drawbacks of nitrogen alloyed austenitic steel, particularly to avoid too low 0.2 limits and to avoid further the excessive use of expensive alloying elements and to avoid additionally manufacturing steps and alloying resulting in an increased difficulty in hot working of the known higher strength nitrogen alloyed austenitic steel.

It is therefore a particular object of the present invention to provide a new and improved corrosion proof austenitic alloy for use as structural materials.

In accordance with the preferred embodiment of the invention the alloy proposed to be used here includes not more than 0.12% C., from 0.075% to 0.55% N, not more than 0.75% niobium but not more than the 4-fold value of the nitrogen used in the alloy; from 16.0 to 32.0% Cr, from 7.0 to 55.0% Ni, not more than 8.5% Mn, not more than 6.5% molybdenum, not more than 3.0% silicon, not more than 4.0% copper, not more than 3.0% tungsten, the remainder being iron as well as unavoidable impurities (all percentages by weight); said alloy is to be run through a high temperature range (above 1000 degrees C.) including hot working and immediately cooling in air or water causing an amount of nitrogen as large as possible in solution, following which the alloy is cold worked, preferably at a 40% to 85% degree of deformation in one or several passes, and subsequently heat treated (annealing, preferably between 800 and 1050 degrees C.), so that precipitations are formed as well as an ultrafine grained recrystallized structure with an average, linear intercept grain size below 8.5 micrometers so as to obtain high yield strength.

The precipitations that are formed and the ultrafine grained recrystallized structure that results from the manufacturing procedure with an average, linear intercept grain size below 8.5 micrometers i.e. larger than app. 10.5 of ASTM, in combination with the nitrogen solution hardening synergistically contribute to an unexpected high yield strength.

In accordance with further preferred features of the present invention the ultra fine grain state has a nitrogen content of 0.22 or 0.45% and niobium and molybdenum as additive in order to obtain yield points of about 730 and 850 N/mm$^2$.

In furtherance of the invention these structure parts are to be used also at elevated temperatures in the range up to about 550 degrees C., the application limit refered to the high temperature 0,2% offset yield strength for calculation of components. This kind of use is deemed justified because high room temperature yield points are obtained through the nitrogen solution hardening and the grain size reduction, and these strengthening effects are maintained also at high temperatures. (see METAL SCIENCE, June 1977, page 210, FIG. 5).

The essential advantages of the invention can be attributed to the kind of working in combination with a particular chemical composition and the technological properties of the alloys to be made. For this reason the seven examples given in the table appended to the specification can be treated in a summary fashion. The table shows ascertained upper and lower yield point, and upper yield point limits over tensile strength, of samples of rolled sheet or plate stock having thickness up to 10 mm and under consideration of DIN 50215, April issue of 1951 and DIN 50145, May issue of 1975. Column 1 shows the composition of the seven samples. Moreover certain information is given about four working steps during the production of the sheet and plate stock and in the sequence, hot rolling of 50 kg of casting at app. 1150 degrees C., solution annealing, cold working and recrystallization annealing. Solution annealing may be dispensed with if the hot working temperatures are sufficiently high as for ex. is the case in the steel of item No. 3.

The most important advantage of the present invention is to be seen in the generation of yield strength in steels or alloys to be used in the almost completely recrystallized state which is not sensitive to stress corrosion but is comparable with the corrosion property of solution annealed steel. This is made evident by columns 6,8–10 of the table. These high yield points are attributable to the combined effect of ultrafine grained recrystallized structure, nitrogen solution hardening and precipitation hardening. The grain-refinement is evidenced through the extremely small grain sizes as shown in column 7 having a size of 2 to 6 micrometers and the solution hardening is evidenced by the high nitrogen content of the molten material being in the range from 0.2 to 0.45%.

A visible light microscopic test revealed that particles regularly disposed in the structure which had precipitated from the austenitic base. This is evidence of a nitride precipitation hardening. Also, the formation of pronounced yield point which cannot be ascertained really in normal nitrogen alloyed austenitic steel can be attributed to this kind of hardening. This aspect is revealed in Column 8 of the table.

Furthermore it has to be considered that in order to optimize the hardening of this kind a starting or beginning state is desired wherein the amount of nitrogen in solution corresponds to highly saturated steel. For this reason one has to work the particular alloys to be used in accordance with the invention prior to cold working recrystallisation annealing such that a high temperature range is run through or hot working carried out followed immediately by cooling. Then and only then will the desired properties be attained. In addition one obtains in this manner a particularly effective solution hardening because the large amount of nitrogen will go into solution and extraction of steel through the formation of nitride is negligibly small.

It is quite surprising that the high yield point values were indeed obtained by superimposing or combining nitrogen solution hardening, nitride precipitation hardening and strong grain-refinement. If one considers in accordance with Berg- und Hüttenmaännische Monatshefte 113, 1968, page 378 et seg. that a yield point increase is obtainable through 0.2, 0.3, and 0.45% nitrogen as a result of solid solution hardening for austenitic chromium nickel steels, respectively being 100, 150, and 245 N/mm$^2$. If one further considers that through nitride precipitation hardening a 90 N/mm$^2$ increase is obtainable and that through ultrafine grain formation a strength increase of 150 N/mm$^2$ can be obtained, then the additive strength increase depending upon the nitrogen content amounts to 340, 390, and 485 N/mm$^2$. For the precipitation free austenitic without nitrogen one finds a grain size from about 50 micrometers corresponding to an ASTM No. 5.5 which is app. the size of solution annealed condition of steels. At the 0.2-limit one can assume app. 255 N/mm$^2$ (see here ASTM Special Technical Publication No. 369 of 1965, page 178, FIGS. 6 and 7 et seg.). Thus, theoretically steel in accordance with the table and having the running number 1, 2, and 3 should be expected at the most to have yield strength of 565; steel per items 4 and 5 would be expected to have a yield strength of 615, and finally the items 6 and 7 are expected to have yield strengths of 710 N/mm$^2$. These are the theoretical maximum values resulting from additively considering the various hardening procedures.

The table shows a significant synergistically obtained increase well beyond these theoretically expected additively combined values. Also it has to be considered that niobium free alloys a precipitation hardening increase on yield strength by 90 N/mm$^2$ is a particularly high assumption and may in practice be unrealizable per se. A comparison shows that the inventive niobium free alloy has even a 10% higher yield point as expected and the niobium containing alloy has an unexpected 20% higher yield point as compared with the maximum values just calculated above. Steel as per items 7, 6, 4 have a particular chemical composition which in accordance with the state of the art type of steel (see above page 4, line 13 and page 6, last line). A comparison here demonstrates particularly the advantage of the inventive alloy and procedure treatment. Thus yield point and strength values from 813 to 870 N/mm$^2$ are attained as compared with the theoretical value of 725. Also a value 685 is attained as compared with the expected value of 490 N/mm$^2$. In the last mentioned example the niobium additive in accordance with the running number 5 of the steel in the table, the relation is even increased from 490 to 783 N/mm$^2$. The steel of No. 1 and 2 show that even such relatively low alloyed steel with good hot workability of the type 18 CR-12 NI-2 MO, one obtains such high yield points through alloying with 0.2% nitrogen which yield points were in the past deemed attainable only with steel having considerably larger amounts of nitrogen which of course entailed a larger amount of chromium, manganese, and nickel for reasons outlined in the introduction.

Another advantage of the invention is to be seen in the use of nitrogen alloyed austenitic steel which includes alloyed components actually rendering deforming more difficult, such as chromium, while hot working is to be avoided because the cubic face centered austenitic is easier deformable at room temperature than at higher temperature. In such cases any stronger segregations will be reduced through diffusion annealing. Whenever ultrafine grain size is attained in accordance with the invention under consideration of the propsed steel alloy then in accordance with the state of the art one can expect a better hot workability such as bending, as compared for example with coarse grained structure.

Tubes or pipes are for ex. to be made in accordance with cold step type reciprocate or pilgrim step rolling under utilization of hot pressed hollows. In the case of steel with poor hot workability these hollows would have to be made in accordance with centrifugal casting. Flat products are to be cold rolled in accordance with the SENDZIMIR or QUARTO methods.

Finally it should be mentioned that the inventive alloys made and to be used in accordance with the invention are of a higher quality on account of more precise sizing and better surface consistency as compared with the usual conventional steel which on account of high wall thickness are usually worked only by hot working.

The invention is not limited to the embodiments described above but all changes and modifications thereof, not constituting departes from the spirit and scope of the invention are intended to be included.

TABLE

APPENDIX
CHEMICAL COMPOSITION (% BY WEIGHT)
Column 1

| No. | N | Nb | Cr | Ni | Mo | Mn | Si | C |
|---|---|---|---|---|---|---|---|---|
| 1 | 0.22 | 0.00 | 18.80 | 12.90 | 2.00 | 1.00 | 0.50 | 0.026 |
| 2 | 0.22 | 0.25 | 18.00 | 12.70 | 2.15 | 0.98 | 0.51 | 0.028 |
| 3 | 0.24 | 0.25 | 23.90 | 40.60 | 0.00 | 4.85 | 0.09 | 0.015 |
| 4 | 0.32 | 0.00 | 22.08 | 10.16 | 0.10 | 1.30 | 0.70 | 0.055 |
| 5 | 0.31 | 0.18 | 21.37 | 9.74 | 0.00 | 1.25 | 0.66 | 0.016 |
| 6 | 0.45 | 0.23 | 23.88 | 16.97 | 3.23 | 5.75 | 0.37 | 0.023 |
| 7 | 0.45 | 0.23 | 23.88 | 16.97 | 3.23 | 5.75 | 0.37 | 0.023 |

| No. | HOT WORKING TEMP. (air cooling) 2 | SOLUTION HEAT TREATMENT 3 |
|---|---|---|
| 1 | app. 1150° C./air C. | 10 min. 1000° C./W |
| 2 | app. 1150° C./air C. | 10 min. 1100° C./W |
| 3 | app. 1150° C./air C. | none |
| 4 | app. 1150° C./air C. | 15 min. 1100° C./W |
| 5 | app. 1150° C./air C. | 15 min. 1200° C./W |
| 6 | app. 1150° C./air C. | 15 min. 1200° C./W |
| 7 | app. 1150° C./air C. | 15 min. 1200° C./W |

| No. | DEGREE OF COLD ROLLING 4 | RECRYSTALLIZATION CONDITIONS 5 | |
|---|---|---|---|
| 1 | 75% | 20 min. | 900° C./L |
| 2 | 75% | 20 min. | 875° C./L |
| 3 | 50% & 50% | 15 min. (each) | 950° C./L |
| 4 | 66% & 50% | 20 min. (each) | 900° C./L |
| 5 | 66% & 66% | 30 min. (each) | 900° C./L |
| 6 | 75% | 10 min. | 975° C./L |
| 7 | 70% | 15 min. | 1000° C./L |

| No. | amount recrystallized 6 | AVERAGE GRAIN SIZE (linear intercept/ ASTM-No) 7 |
|---|---|---|
| 1 | 97% | 5.20 $10^{-6}$ m/No. 12 |
| 2 | 98% | 2.86 $10^{-6}$ m/No. 13.5 |
| 3 | 100% | 4.30 $10^{-6}$ m/No. 12.5 |
| 4 | 100% | 3.30 $10^{-6}$ m/No. 13 |
| 5 | 100% | 2.35 $10^{-6}$ m /No. 14 |
| 6 | 95% | 3.51 $10^{-6}$ m/No. 13 |
| 7 | 97% | 3.87 $10^{-6}$ m/No. 12.5 |

| No. | YIELD STRENGTH ($N/mm^2$) (longitudinal) UPPER 8 | LOWER | RUPTURE ELONGATION ($l_0 = 5d$) 9 | UPPER YIELD STRENGTH DIVIDED BY TENSILE STRENGTH 10 |
|---|---|---|---|---|
| 1 | 614 | 614 | 41% | 71% |
| 2 | 733 | 725 | 37% | 80% |
| 3 | 645 | 640 | 38% | 72% |
| 4 | 658 | 658 | 40% | 75% |
| 5 | 783 | 783 | 35% | 80% |
| 6 | 870 | 860 | 35% | 76% |
| 7 | 813 | 811 | 36% | 75% |

I claim:

1. The Method of making components of structural material expected to be exposed to corrosion mediums in combination with high mechanical loads comprising the steps of providing an alloy consisting of not more than 0.12% C, from 0.075% to 0.55% N, not more than 0.75% niobium but not more than the 4-fold value of the nitrogen used in the alloy; from 16.0 to 32.0% Cr, from 7.0 to 55.0% Ni, not more than 8.5% Mn, not more than 6.5% molybdenum, not more than 3.0% silicon, not more than 4% copper, not more than 3,0% tungsten, the remainder being iron as well as unavoidable impurities (all percentages by weight);

heat treating the alloy at a high temperature for obtaining a relatively large amount of nitrogen to go into solution;

immediately cooling, subsequently cold working and recrystallization annealing the alloy so that precipations as well as an ultrafine grained structure with an average, linear intercept grain below 8.5 micrometers have formed so as to obtain a relatively high yield strength.

2. The method as in claim 1, said temperature range of heat treatment being above 1000 degrees C.; said cold working amounting to 40–85 degree of deformation, said annealing being carried out between 800 and 1050 degrees C.

3. The method as in claim 1, wherein said heat treatment consists of a high temperature range run above 1000 degrees C. and immediately cooled to RT.

4. The method as in claim 1, wherein said heat treatment is or includes hot working steps above about 1000 degrees C.—preferably at 1150 degrees C.—and subsequently air cooled.

5. The method as in claim 1, wherein said heat treatment consists of a hot working step or a high temperature range run above 1000 degrees C. accompanied with subsequent solution annealing between 1000 and 1200 degrees C.

6. A structural material for use under corrosion conditions in combination with high mechanical load comprising an alloy of not more than 0.12% C., from 0.075% to 0.55% N, not more than 0.75% niobium but not more than the 4-fold value of the nitrogen used in the alloy; from 16.0 to 32.0% Cr, from 7.0 to 55.0% Ni, not more than 8.5% Mn, not more than 6.5% molybdenum, not more than 3.0% silicon, not more than 4% copper, not more than 3.0% tungsten, the remainder being iron as well as unavoidable impurities (all percentages by weight);

said alloy having been heat treated above about 1000 degrees C. so as to obtain the highest possible degree of nitrogen to be in solution, said alloy being solution hardened accordingly;

said alloy having been cooled and cold worked and recrystallization annealed so that nitride precipitation as well as an ultrafine grained structure with an average, linear intercept grain below 8.5 micrometers have formed in order to obtain high yield strength.

7. A structural material as in claim 6, said nitrogen content being from 0.22 to 0.45% and yield strength obtaining from 614 to 870 $N/mm^2$.

8. A structural material as in claim 6, said high 0,2% offset yield strength in the temperature range up to about 550 degrees C.

* * * * *